US005647765A

United States Patent [19]

Haas et al.

[11] Patent Number: 5,647,765

[45] Date of Patent: Jul. 15, 1997

[54] SHIELDED CONNECTOR WITH CONDUCTIVE GASKET INTERFACE

[75] Inventors: Orville A. Haas, Pocahontas, Ark.; Edward A. Karale, Fremont, Calif.

[73] Assignee: Regal Electronics, Inc., Santa Clara, Calif.

[21] Appl. No.: 526,991

[22] Filed: Sep. 12, 1995

[51] Int. Cl.[6] ..... H01R 13/648

[52] U.S. Cl. ..... 439/609; 439/607; 439/676

[58] Field of Search ..... 439/607, 608, 439/609, 101, 108, 660, 676, 701, 709, 712

[56] References Cited

U.S. PATENT DOCUMENTS

| | | | |
|---|---|---|---|
| 4,703,991 | 11/1987 | Philippson | 439/676 |
| 5,112,251 | 5/1992 | Cesar . | |
| 5,158,480 | 10/1992 | Blondeel et al. | 439/607 |
| 5,169,346 | 12/1992 | Johnston | 439/676 |
| 5,178,563 | 1/1993 | Reed | 439/676 |
| 5,195,911 | 3/1993 | Murphy | 439/607 |
| 5,207,597 | 5/1993 | Kline et al. | 439/607 |
| 5,228,872 | 7/1993 | Liu | 439/607 |
| 5,281,169 | 1/1994 | Kiat et al. | 439/607 |
| 5,312,273 | 5/1994 | Andre et al. | 439/607 |
| 5,326,281 | 7/1994 | Yin | 439/607 |
| 5,348,484 | 9/1994 | Sorrentino . | |
| 5,378,172 | 1/1995 | Roberts | 439/607 |
| 5,382,182 | 1/1995 | Shen et al. | 439/676 |
| 5,397,250 | 3/1995 | Briones | 439/620 |
| 5,445,542 | 8/1995 | Serizay | 439/609 |

FOREIGN PATENT DOCUMENTS

WO90/16096 12/1990 WIPO .

*Primary Examiner*—Hien Vu

*Attorney, Agent, or Firm*—Law Offices of Thomas E. Schatzel A Prof. Corporation

[57] ABSTRACT

A modular jack for interfacing a modular plug with a printed circuit board. The jack has a first outer housing segment and a second outer housing segment with a plurality of contacts embedded within the second segment and having pin portions projecting therefrom about one terminal end and contact portions projecting therefrom about the other terminal end with the contact portions being insertable within the first housing segment to make interface contact and mating with a male plug. The modular jack may include a shield with an electrically conductive compliant member about the edge of the shield to make interface electrical connection with a panel when the modular jack is mounted in place.

15 Claims, 1 Drawing Sheet

SHIELDED CONNECTOR WITH CONDUCTIVE GASKET INTERFACE

BACKGROUND OF THE INVENTION

1. Field of the Invention

This invention relates to electrical connectors and more particularly to shielded connector assemblies providing protection against electromagnetic interference, radio frequency interference, and the like.

2. Description of the Prior Art

Shielded electrical jack connector systems are used in many applications, e.g. telecommunications equipment, computers, other digital information systems, etc. Such jack connectors are commonly mounted on the surface of printed circuit boards which include ground planes or ground circuits. The electrical circuitry connected with such jack connectors commonly include mateable male plugs mounted to a plurality of electrical cables having a plurality of electrically conductive leads surrounded by an electrically conductive shield and which are respectively connected to terminals in the plug. It is commonly necessary to shield the circuits carrying signals to avoid unwanted electromagnetic interference generated from within and/or outside the system.

One type of electrical connector is a telecommunication rectangular shielded electrical connector assembly which includes a rectangular shaped dielectric housing with outer surfaces covered at least in part by a metal shield with walls covering outside wall surfaces of the housing. An illustrative example is shown in U.S. Pat. No. 5,281,169.

A shortcoming of prior art shielded electrical connector assemblies is encountered with panel mounted connectors and resultant electrical contact with the panel. In such applications, the connector is mounted on a printed circuit board such that a wall of the shield lies just beyond the edge of the printed circuit board. Then, the printed circuit board is positioned with its forward edge against the rear face of a metal panel, e.g. an external panel of an electronic apparatus such as a computer. In such applications, it is common for the wall of the shield to protrude through a rectangular hole in the panel to enable the connector to receive a shielded data-link plug to connect the apparatus to a peripheral electronic apparatus. However, shortcomings are commonly encountered with the electrical contact between the shield and the panel.

SUMMARY OF THE PRESENT INVENTION

An object of the present invention is to provide a modular jack that assures electrical contact between the jack and a panel to provide a ground path therebetween.

Another object of the present invention is to provide a shielded modular jack that provides for flexible electrical contact between the jack and a panel.

Another object of the present invention is to provide a shielded modular jack that provides for flexible electrical contact between the jack and a panel and which is economical to manufacture.

A preferred embodiment of the present invention includes a modular jack connector having a first outer housing segment of a nonconductive dielectric material and formed by opposed top and bottom walls and opposed side walls, said top, bottom and side walls being integrally formed and defining an interior longitudinally extending cavity between them for creating a forward female plug receptacle space. A second outer housing segment formed by a block of nonconductive dielectric material is fixed about said top wall and said bottom wall. A plurality of jack contacts, with each of the jack contacts including a pin portion, a contact portion, and an interconnecting portion interconnecting said pin and contact portion are mounted to the second outer housing segment. The interconnecting portions are embedded in and extend from a first end to a second end of the second outer housing segment and said pin portions project from said first end and said contact portions project from said second end. The contact portions extend transversely from the second outer housing segment with said contact portion positioned within said forward plug receptacle cavity and in position to electrically interface and mate with a compatible plug inserted in the cavity. A metal shield covers outside wall surfaces of the first outer housing segment, and an electrically conductive compliant member is adhered to the first peripheral edge of the shield and positioned to make electrical contact with the shield and a panel when the connector is mounted adjacent to the panel.

In another embodiment designed to simultaneously accommodate a plurality of plugs, the first housing segment includes a partition wall extending transversely through said space and between said opposed side walls and projecting upwardly from said bottom wall and dividing said longitudinal cavity into multiple forward plug receptacle spaces bounded by said top, said bottom, said partition and said side walls.

Improvement of transfer impedance of a shielded connector, requires that the inductance and discontinuities be reduced to low values over a wide range of frequencies. For optimum shield performance, all connecting parts should make complete homogenous contact or bonding between each part. With a continuous connection applying constant pressure at all points, the inductance of the interconnect is decreased. The preferred embodiments incorporate an electrically conductive compliance member which includes a compliant foam, e.g. thermoplastic rubber, covered by a conductive fabric, e.g. woven strands of nickel coated copper wire. The electrically conductive compliant member extends about the peripheral edge of the shield to form a continuous connection between the connector shield and the mating panel or enclosure. The method of fastening the compliant member to the connector is by adhesive and/or mechanical clamping. The adhesive provides stability of the gasket during assembly while crimped tabs formed in the connector shield, provide the final mechanical clamping and electrical bonding of the parts. The conductive fabric over wraps the core. The adhesive, when used, covers only a small strip on the gasket/connector mate surfaces. As a result, uniform electrical connection is made when the mounting tabs are bent over and clamp the gasket against the metal surface of the connector shield.

During installation of the connector into a metal panel cutout, the electrically conductive gasket surfaces at the front edge of the connector tend to retract towards the rear of the connector body and are firmly compressed against the inside wall surface of the panel cutout. This forms an electrically low impedance seal or bond around the entire perimeter of the connector and panel cutout. This increases the total contact surface to nearly one hundred percent. Since the gasket is both compliant and forgiving, it takes on the shape of any irregular surfaces of the shield and/or opening in the panel.

An advantage of the present invention is that it provides a modular jack that assures electrical contact between the jack and a panel to provide a ground path therebetween.

Another advantage of the present invention is that it provides a shielded modular jack that provides flexible electric contact between the jack and a panel.

Another advantage of the present invention is that it provides a shielded modular jack which is economical to manufacture.

These and other objects and advantages of the present invention will no doubt become obvious to those of ordinary skill in the art after having read the following detailed description of the preferred embodiments.

IN THE DRAWINGS

DETAILED DESCRIPTION OF THE PREFERRED EMBODIMENT

Figures 1, 2, 3, 4, 5, 6, 7:
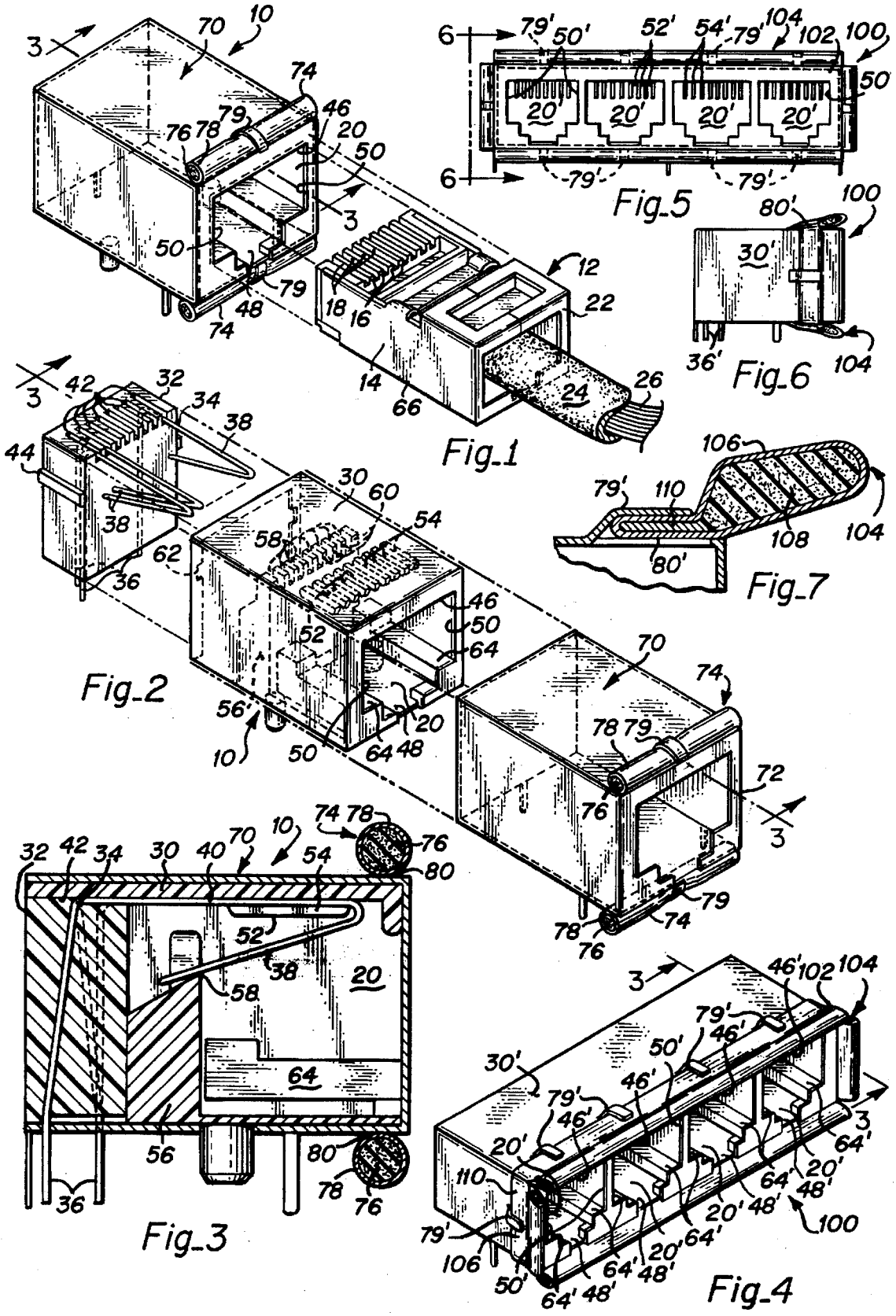
FIG. 1 is a perspective view of a modular jack connector of the present invention aligned to receive a RJ-45 type plug.
FIG. 2 is an exploded view of the jack connector of FIG. 1.
FIG. 3 is a cross-sectional view of the jack connector of FIG. 1 taken along the line 3—3.
FIG. 4 is a perspective view of an alternative embodiment of the present invention in the form of a modular jack connector for receiving multiple plugs.
FIG. 5 is a front planar view of the connector of FIG. 4.
FIG. 6 is a side planar view of the connector of FIG. 4.
FIG. 7 is an enlarged, cross-sectional view of the electrically conductive compliant member of the connector of FIG. 4.

FIGS. 1–3 illustrate a modular jack connector of the present invention and referred to by the general reference character 10. As illustrated in FIG. 1, the modular jack connector 10 is adapted to receive a plug, e.g. RJ-45 plug referred to by the general reference character 12. The plug 12 includes a dielectric housing 14 mounting a plurality of terminals 16 disposed within discrete slots 18 in the housing 14. The housing 14 is dimensioned for insertion into a plug receiving cavity 20 of the modular jack connector 10. The plug 12 further includes an external metallic shield 22 which is in electrical contact with a shield 24 surrounding a cable 26. In particular, the cable 26 includes a plurality of leads which are electrically connected to the terminals 16. The electrically conductive shield 24 is in the form of a braid or foil extending around the leads 26.

The modular jack electrical connector assembly 10 defines a female electrical connector having a first nonconductive outer housing segment 30 of dielectric material and a second outer housing segment 32 of dielectric material which slides within the housing segment 30. Embedded within the segment 32 is a plurality of jack contacts 34 which are formed from a wire, e.g. substantially of rectangular cross-section. Each of the jack contacts 34 has a pin portion 36 for mounting to a printed circuit board to make electrical connection to conductive areas on the printed circuit board. Each jack contact 34 further includes a contact portion 38 with an interconnection portion 40 interconnecting the pin portion 36 to the contact portion 38. The interconnection portion 40 is bent at approximately right angles at the point wherein the portion 40 projects from the outer housing segment 32 and extends within a slot 42 formed in the top surface of segment 32. Thus, the jack contacts 34 project from segment 32 and slide within the interior of the segment 30. The segment 32 further includes a pair of ribs 44 projecting from each side surface.

The first outer housing segment 30 includes a top wall 46, a bottom wall 48 and a pair of end side walls 50 to form the cavity 20 which serves as a plug receiving opening (data-link plug receptacle). The cavity 20 is dimensioned so as to be compatible to receive the plug 12. About the top wall 46 are formed a plurality of slots 52 intermediate adjacent ribs 54. Thus, each of the interconnection pin portions 40 of the jack contacts 34 slide through the slots 52 and are electrically insulated and physically separated from adjacent jack contacts 34. Also supported between the side walls 50 within the cavity 20, and adjacent to the segment 32, is a pin contact support bridge 56. The bridge 56 forms a plurality of slots 58 formed intermediate adjacent ribs 60. Each of the slots 58 are in alignment with one of the slots 52 such that the terminal end of each of the contact portions 38 rest upon the bridge 56 and are electrically and physically insulated from the adjoining contact 38.

Thus, when the plug 12 is inserted within the connector 10, each of the contacts 38 is in alignment with contacts 16 of the plug 12. As the plug 12 is inserted within the cavity 20, electrical contact is made between each of the aligned contacts. The contact portions 38, being bent over the interconnection portion 40 and resting on the bridge 56 have a spring-like relationship and thus make frictional contact with the contacts on the plug 18 and when the plug 12 is removed, the contacts 38 rest against the bridge 56.

Also, to aid assembly, the segment 30 includes a slot 62 in each of the side walls 50 with the slot 62 in alignment with the rail 44 of the segment 32. Thus, the segment 32 may be slid within the cavity 20 from the rear side with the rails 44 in place in slots 62.

The bottom wall 48 of the segment 30 includes ledges 64 to be compatible and mate with a bottom surface 66 of the plug 12.

To provide electromagnetic shielding of the electrical connector assembly 10, a stamped metallic shield, referred to by the general reference character 70, is placed over the segment 30. The shield 70 is a generally rectangular conductive material which is disposed about the segment 30 and defines a peripheral envelope with a front face 72 to integrally mate with the configuration of the face about the cavity 20. About the edge of the face 72 is an electrically conductive compliant member, referred to by the general reference character 74, and having a compliant foam core 76 surrounded by a conductive fabric 78. The electrically conductive compliant member 74 is secured to the shield 70 by a plurality of metallic hooks 79 projecting from the shield 70 and an adhesive 80. Thus, when the electrical connector assembly 30 is mounted in place on a metal panel, the electrically conductive compliant member makes electrical contact with the panel and simultaneously makes electrical contact with the shield 70 so as to provide a continuous electrical circuit path to the ground reference. With the shield 70 positioned within the interior of a panel and the face 72 penetrating an opening in such panel, the member 74 is simultaneously compressed against the edge of the panel wall forming such opening and the shield 70. Thus, the member 74 takes shape to conform to irregularities in the opening while making continuous electrical contact.

FIGS. 4–6 illustrate an alternative embodiment of the present invention in the form of a multiple modular electrical connector assembly and referred to by the general reference character 100. Those components of assembly 10, have the same reference number characterized by a prime designation. The assembly 100 includes a plurality of the assemblies 10 joined in unison to form multiple cavities 20' and to receive multiple plugs 12. The assembly 100 is internally the same as the unit 10 such that FIG. 3 is a proper illustrative cross-sectional diagram along the lines 3—3 of FIG. 4.

In the assembly 100, the side walls 50' intermediate the individual cavities 20' further serve as a partition wall to divide the individual cavities 20'. In the assembly 100, the shielding comprises a metallic face plate 102 about the openings of the cavities 20' with an electrically conductive compliant member, referred to by the general reference character 104 adhered thereto and to the housing segment 30' by means of the adhesive 80' and the metallic hooks 79' bent over from the face 102. Thus, there is electrical circuitry between the metallic face plate 102 and electrically conductive compliant member 104. With the module 100 mounted about an opening in a panel, the electrically conductive compliant member 104 makes continuous contact with the edge of the panel about the entire periphery. Being compliant, the member 104 accommodates irregularities in the surface of the edge of the opening as well as any irregularities in the plate 102 to assure the continuous electrical contact.

FIG. 7 illustrates the electrically conductive compliant member 104 in greater detail. The member 104 includes a fabric material 106, e.g. woven strands of nickel coated copper wire, about a compliant core material 108, e.g. thermoplastic rubber, projecting from a rigid carrier 110, e.g. polypropylene. The adhesive 80' makes a narrow strip to adhere to the peripheral edge of the housing segment 30' and the hooks 79' make further mechanical fastening of the member 104 to the shield 102.

When installing the assemblies 10 or 100 into a panel, the assembly 10 and/or 100 is installed from the rear of the panel such that as the face of the connector panel 100 protrude through the opening in the panel, the compliant members 74 and 104' are compressed about the edge of the opening therefore making continuous contact with the edge of the panel while also being compressed to increase the surface area of contact with the shield 70 and/or shield face 102. Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A modular jack (10) for connection to a printed circuit board and receipt of a modular plug (12), comprising:

an outer housing (30, 32) comprised of an electrically insulative material having opposed top wall (46), bottom wall (48) side walls (50), and a back wall segment (32) being integrally formed and defining an interior longitudinally extending cavity (20) between them, said cavity forming an externally extending opening about a front end of the housing for receipt of a plug having electrical contacts;

a plurality of jack contacts (34), each of the jack contacts (34) including a pin portion (36), a contact portion (38) and an interconnecting portion (40) interconnecting said pin portion (36) and contact portion, said contact portion (36) positioned within said cavity (20) and said pin portion extending externally to the housing for mounting on a printed circuit board;

an electrically conductive shield member (70, 102) engaged to an exterior surface of the outer housing (30, 32) about said opening;

an electrically conductive compliant member (74) comprised of a compliant foam core (76) surrounded by a conductive material and extending about an external edge of the shield member and in electrical connection with the shield, such that when the housing is positioned on an electrically conductive panel and said front end is positioned about an opening of said panel, the electrically conductive compliant member makes electrical contact with said panel to create an electrically conductive path between the shield, the compliant member and said panel; and fastening means (80) securing the electrically conductive compliant member (74) to the shield member (70).

2. The modular jack of claim 1 further including, hooks (79) extending from an edge of the shield member adjacent to the electrically conductive compliant member, the hooks being bent over and securing the compliant member in place.

3. The modular jack of claim 2 wherein, the electrically conductive compliant member (74) extends about substantially all of the peripheral edge of the shield member (70, 102).

4. The modular jack of claim 1 wherein, the electrically compliant member includes a planar strip of carrier material, a compliant foam core material projecting from said planar strip at an acute angle and a fabric electrically conductive material surrounding said planar strip and said core.

5. The modular jack of claim 4 wherein, the adhesive means secures said planar strip to the shield member.

6. The modular jack of claim 4 further including, hooks extending from an edge of the shield member adjacent to the electrically conductive compliant member, the hooks being bent over and securing said planar strip in place.

7. A modular jack (10) for connection to a printed circuit board and receipt of a modular plug (12), comprising:

a first outer housing segment (30) formed by opposed top (46) and bottom walls (48) and opposed side walls (50), said top (46), bottom (48) and side walls (50) being integrally formed and defining an interior longitudinally extending cavity (20) between them, said cavity forming an external opening for receipt of a plug having electrical contacts;

a second outer housing segment (32) formed by a block fixed to said top wall (46) and said bottom wall (48);

a plurality of jack contacts (34), each of the jack contacts (34) including a pin portion (36), a contact portion (38) and an interconnecting portion (40) interconnecting said pin portion (36) and contact portion (38), said interconnecting portion (40) being embedded in and extending from a first end to a second end of the second outer housing segment (32) with said pin portion (36) projecting from said first end and said contact portion (38) projecting from said second end and extending transversely from the second outer housing segment with said contact portion (38) positioned within said cavity (20);

electrically conductive shield member (70, 102) engaged to an exterior surface of the first outer housing segment (30) about said opening;

an electrically conductive compliant member (74) comprised of a compliant foam core (76) surrounded by a conductive fabric and extending about an external edge of the shield member and in electrical connection with the shield, such that when the housing is positioned on an electrically conductive panel and said front end is positioned about an opening of said panel, the electrically conductive compliant member makes electrical contact with said panel to create an electrically conductive path between the shield, the compliant member and said panel; and adhesive means (80) securing the electrically conductive compliant member (76) to the shield member (70).

8. The modular jack of claim 7 wherein, each of said contact portions (38) being bent over said interconnecting portion (34) to form a lever spring contact.

9. The modular jack of claim 8 further including, a support bridge (56) extending longitudinally within said cavity and between said side walls, the bridge (56) including a plurality of separating slots (58), each of said lever spring contacts (38) resting on the support shelf (56) within one of said slots (58).

10. The modular jack of claim 9 further including, a first plurality of ribs (60), each of said first plurality of ribs (60) extending transversely within said cavity (20) from the support bridge to form slots (58), whereby the first plurality of ribs (60) limit lateral movement of said lever spring contacts (38) and provide electrical insulation between adjacent spring contacts (38).

11. The modular jack of claim 10 wherein, said interconnecting portion (40) of each of the jack contacts (34) projects in said cavity (20) along said top wall (46), and further including, a second plurality of ribs (54), each of said second plurality of ribs (54) extending transversely within said cavity (20) from said top wall (46) to form a plurality of slots (52) to receive said interconnecting portions (40) of the jack contacts (34), whereby the second plurality of ribs (54) limits lateral movement of said interconnecting portions (40) of the jack contacts (34).

12. The modular jack of claim 11 wherein, the first outer housing segment (30) further includes a partition wall (50') extending transversely through said cavity (20) and between said opposed side walls (50') and projecting upwardly from said bottom wall (48') and dividing said cavity (20') into a plurality of forward plug receptacle spaces bounded by said top (46'), said bottom (48') and said side walls (50').

13. A modular jack (10) for connection to a printed circuit board and receipt of a modular plug (12), comprising:

an outer housing (30, 32) comprised of an electrically insulative material having opposed top wall (46), bottom wall (48) side walls (50), and a back wall segment (32) being integrally formed and defining an interior longitudinally extending cavity (20) between them, said cavity forming an externally extending opening about a front end of the housing for receipt of a plug having electrical contacts;

a plurality of jack contacts (34), each of the jack contacts (34) including a pin portion (36), a contact portion (38) and an interconnecting portion (40) interconnecting said pin portion (36) and contact portion, said contact portion (36) positioned within said cavity (20) and said pin portion extending externally to the housing for mounting on a printed circuit board;

an electrically conductive shield member (70, 102) engaged to an exterior surface of the outer housing (30, 32) about said opening;

an electrically conductive compliant member (74) comprised of a compliant foam core (76) surrounded by a conductive fabric and extending about an external edge of the shield member and in electrical connection with the shield, such that when the housing is positioned on an electrically conductive panel and said front end is positioned about an opening of said panel, the electrically conductive compliant member makes electrical contact with said panel to create an electrically conductive path between the shield, the compliant member and said panel; and tabs (79) extending from an edge of the shield member adjacent to the electrically conductive compliant member, the tabs being bent over and securing the compliant member in place.

14. The modular jack of claim 13 further including, adhesive means (80) for securing the electrically conductive compliant member (74) to the shield member (70, 102), and with the electrically conductive compliant member (74) extending about substantially all of the peripheral edge of the shield member (70, 102).

15. A modular jack (10) for connection to a printed circuit board and receipt of a modular plug (12), comprising:

an outer housing (30, 32) comprised of an electrically insulative material having opposed top wall (46), bottom wall (48) side walls (50), and a back wall segment (32) being integrally formed and defining an interior longitudinally extending cavity (20) between them, said cavity forming an externally extending opening about a front end of the housing for receipt of a plug having electrical contacts;

a plurality of jack contacts (34), each of the jack contacts (34) including a pin portion (36), a contact portion (38) and an interconnecting portion (40) interconnecting said pin portion (36) and contact portion, said contact portion (36) positioned within said cavity (20) and said pin portion extending externally to the housing for mounting on a printed circuit board;

an electrically conductive shield member (70, 102) engaged to an exterior surface of the outer housing (30, 32) about said opening;

an electrically conductive compliant member (74) comprised of a planar strip of carrier material, a compliant core material projecting from said planar strip at an acute angle and a fabric electrically conductive material surrounding said planar strip and said core and extending about an external edge of the shield member and in electrical connection with the shield, such that when the housing is positioned on an electrically conductive panel and said front end is positioned about an opening of said panel, the electrically conductive compliant member makes electrical contact with said panel to create an electrically conductive path between the shield, the compliant member and said panel; and hooks extending from an edge of the shield member adjacent to the electrically conductive compliant member, the hooks being bent over and securing said planar strip in place.

* * * * *